United States Patent [19]

Bauer et al.

[11] Patent Number: 4,810,254

[45] Date of Patent: Mar. 7, 1989

[54] WET-FASTNESS PROPERTIES OF SULPHUR DYESTUFFS DYEINGS ON CELLULOSE TREATED WITH POLY-DI-ALLYL-AMMONIUM SALT

[75] Inventors: Wolfgang Bauer, Maintal; Karl-Heinz Keil, Hanau-Mittelbuchen; Gert Nagl, Niederdorfelden; Manfred Kaiser; Joachim Steinbach, both of Frankfurt; Klaus Sternberger, Bad Vilbel, all of Fed. Rep. of Germany

[73] Assignee: Cassella Aktiengesellschaft, Frankfurt am Main, Fed. Rep. of Germany

[21] Appl. No.: 149,011

[22] Filed: Jan. 27, 1988

[30] Foreign Application Priority Data

Feb. 4, 1987 [DE] Fed. Rep. of Germany ..... 3703293

[51] Int. Cl.[4] ..... D06P 1/52; D06P 5/08

[52] U.S. Cl. ..... 8/554; 8/495; 8/555; 8/650; 8/651; 8/652; 8/918

[58] Field of Search ..... 8/554, 555, 652, 554, 8/650, 651, 495

[56] References Cited

U.S. PATENT DOCUMENTS 4,583,989 4/1986 Ueda et al. ..... 8/543
4,678,474 7/1987 Ueda et al. ..... 8/543

FOREIGN PATENT DOCUMENTS

55/076177 6/1980 Japan .
57/011288 1/1982 Japan .
57/210083 12/1982 Japan .

OTHER PUBLICATIONS

Ottenbrite, R. M. and Ryan, W. S., Ind. Eng. Chem. Prod. Res. Dev., 1980, vol. 19, (No 4), (pp. 528-532).

*Primary Examiner*—A. Lionel Clingman
*Attorney, Agent, or Firm*—Connolly and Hutz

[57] ABSTRACT

The wet-fastness properties of cellulose materials dyed with sulfur dyestuffs is improved by treating the cellulose materials, before, during or after dyeing, with a polymer which is a copolymer or homopolymer of a monomer of the formula

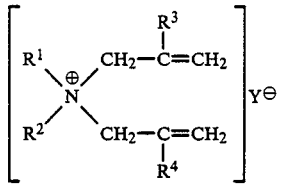

(I)

wherein $R^1$ and $R^2$ denote, for example, hydrogen or ($C_1$-$C_{22}$)-alkyl; $R^3$ and $R^4$ denote hydrogen or methyl; and $Y^{\ominus}$ denotes, for example, a monovalent anion.

17 Claims, No Drawings

WET-FASTNESS PROPERTIES OF SULPHUR DYESTUFFS DYEINGS ON CELLULOSE TREATED WITH POLY-DI-ALLYL-AMMONIUM SALT

The intention relates to a process for improving the wetfastness properties of dyeings with sulphur dyestuffs on cellulose.

Cellulose can be dyed with sulphur dyestuffs by the exhaustion process from a long or short liquor or by a large number of processes on dyeing apparatuses and dyeing machines. For example, dyeing can be carried out semi-continuously on pad-roll units or by the pad roll-up method or by the cold batch method. Sulphur dyestuffs can also be used for entirely continuous dyeing, for example by the pad-steam process or the thermosol continuous process and the like.

For dyeing, water-insoluble sulphur dyestuffs are initially converted by reduction, usually with sodium sulphide or sodium hydrosulphide, into the soluble leuco form, which has affinity for fibres, and is applied to the fibres in this form and then oxidized. Modified sulphur dyestuffs, for example in water-soluble form, are also commercially available, in particular for dyeing in circulating liquor machines. The water-soluble sulphur dyestuffs can be dissolved in water without a reducing agent and only acquire affinity for fibres after addition of reducing agents and alkali.

Good wet-fastness properties, in particular good fastnesses to washing, are being required more and more of dyed articles. However, many sulphur dyestuffs give only moderate wet-fastness properties, especially when certain methods of oxidation are used.

There has therefore been no lack of attempts to achieve an improvement in the fastness of the sulphur dyeing to washing by using after-treatment agents. Thus, the fastness properties of dyeings with sulphur dyestuffs can be improved by an after-treatment with peralkylation products of polyamines (German Patent Specification No. 831,540). Corresponding commercial products are recommended for use in the acid pH range, because odour nuisances may occur even in a weakly alkaline medium due to the amine smell.

It is also known that the fastness properties of sulphur dyestuff dyeings can be improved by after-treatment with alkylating agents (compare, for example, German Patent Specifications Nos. 131,758, 907,643, 929,963, 952,619, 1,264,387, 1,268,585, 1,151,241, 1,221,607 and 1,240,499). The after-treatment of the dyeings is as a rule carried out after the rinsing before an oxidation treatment. The improvement in the fastness properties is attributed to the cationic and alkylating action. However, since various positions in the molecule of the sulphur dyestuff can be alkylated, depending on the oxidation level of the sulphur dyestuff, varying strengths and colour shades are possible at the time of application, depending on the degree of oxidation of the dyeing, and this causes unlevel results. Reaction temperatures close to 100° C. are also as a rule necessary for using the aftertreatment agents. A further disadvantage is that the alkylating after-treatment agents react not only with the sulphur dyestuff but also with the cellulose and are thereby anchored onto the fibre. In the event of a faulty dyeing, the auxiliary can therefore no longer be removed, but must be destroyed under such drastic oxidation conditions that damage to the fibre cannot reliably be avoided, if the sulphur dyestuff is to be taken up uniformly on renewed dyeing.

The possibility of applying alkylating auxiliaries after the dyeings have been finished has the disadvantage that the goods must be rinsed again after the application in order to remove ecess alkylating agent. Moreover, this type of application is toxicologically unacceptable because of any residue of the alkylating agent which remains on the fibre.

The object of the present invention is therefore to provide a process by which the wet-fastness properties, in particular the fastnesses to washing, of dyeings with sulphur dyestuffs can be improved without the disadvantages customary to date thereby arising. The object of the invention is achieved according to the claims.

The invention relates to a process for improving the wetfastness properties of dyeings with sulphur dyestuffs on cellulose, characterized in that the cellulose is treated with a polymer containing, in copolymerized form, 16 2/3 to 100 mol % of a compound of the formula I

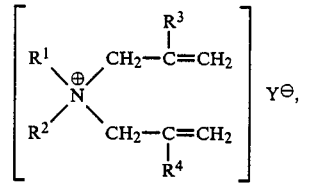

(I)

wherein $R^1$ and $R^2$ denote hydrogen; $(C_1-C_{22})$alkyl, which can optionally be interrupted by —CO—NH—or —NH—CO—; or hydroxyalkyl; $R^3$ and $R^4$ denote hydrogen or methyl; and $Y^{\ominus}$ denotes a monovalent anion or a portion of a polyvalent anion equivalent to a monovalent anion, before, during or after the dyeing operation.

The radicals $R^1$ and $R^2$ on the one hand and $R^3$ and $R^4$ on the other hand can be identical or different. The radicals $R^1$, $R^2$, $R^3$ and $R^4$ can also all be identical and can denote hydrogen or methyl. The alkyl radicals and hydroxyalkyl radicals $R^1$ and $R^2$ can be straight-chain or branched. $R^1$ and $R^2$ preferably represent uninterrupted alkyl radicals with 1 to 10C atoms, and especially preferably uninterrupted alkyl radicals with 1 to 4C atoms.

Examples of suitable alkyl radicals $R^1$ and/or $R^2$ are: n-docosyl, n-pentadecyl, n-decyl, i-octyl, i-heptyl, n-hexyl, i-pentyl and, preferably, n-butyl, i-butyl, sec-butyl, i-propyl, n-propyl, ethyl and methyl.

The radicals $R^1$ and $R^2$ are preferably identical and thereby preferably both denote methyl.

$R^3$ and $R^4$ are preferably also identical and thereby preferably both denote hydrogen.

A monovalent anion for $Y^{\ominus}$ can be, for example, nitrate, bisulphate, benzenesulphonate, fluoride, chloride, bromide, iodide, acetate, propionate or another radical of a carboxylic acid. A portion of a polyvalent anion equivalent to a monovalent anion can be, for example, $\frac{1}{2}$ equivalent of sulphate or $\frac{1}{3}$ equivalent of phosphate. $Y^{\ominus}$ preferably represents a halogen anion, such as bromide or iodide, or in particular chloride.

The compounds of the formula I, like the polymers derived therefrom, are known (compare, for example, Ottenbrite and Ryan, Cyclopolymerization of N,N-Dialkyldiallylammonium Halides, Ind. Eng. Chem. Prod. Res. Dev. Volume 19, No. 4, (1980), 528–532). It is to be assumed that on homo- and copolymerization of compounds of the formula I, chiefly 5- or 6-membered cyclic recurring units of the forulae II and III

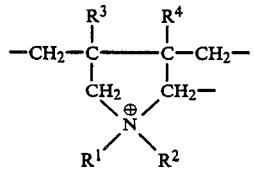

(II)

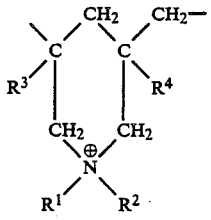

(III)

are formed in the polymer. In copolymers, the recurring units to be formed from the compound I can also have different structures, depending on the comonomers employed. For example, recurring units of the formulae IV, V or VI may form if sulpher dioxide is employed alongside compounds of the formula I in a polymerization reaction.

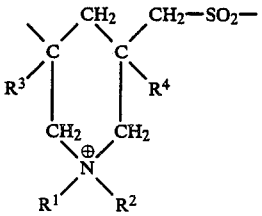

(IV)

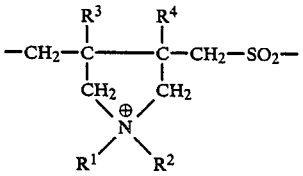

(V)

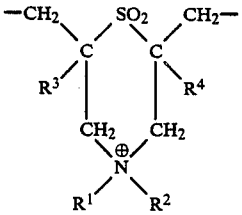

(VI)

In the recurring units shown in the formulea II to VI, the associated anion $Y^{\ominus}$ *has in each case been omitted.*

The polymer used contains $16\frac{2}{3}$ to 100 mol %, preferably 40 to 100 mol % and especially preferably 80 to 100 mol %, of a compound of the formula I in copolymerized form.

A polymer with 100 mol % of a compound of the fornula I in copolymerized form is prepared by polymerization of one or more compounds of the formula I in a manner which is known per se. To prepare polymers containing less than 100 mol % of a compound of the formula I in copolymerized form, one or more compounds of the formula I are copolymerized together with sulphur dioxide and/or with one or more other comonomers in a manner which is known per se, the molar ratios being maintained in an appropriate manner. Suitable comonomers for such a copolymerization are, for example, acrylamide, methacrylamide, N,N-dimethylaminopropylacrylamide, N,N-diethylaminopropylacrylamide, N,N-dimethylaminopropylmethacrylamide, N,N-diethylaminopropylmethacrylamide, N,N-dimethylaminobutylacrylamide, N,N-diethylaminobutylacrylamide, N,N-dimethylaminobutylmethacrylamide and N,N-diethylaminobutylmethacrylamide.

Particularly preferred comonomers for the preparation of the polymers used in the process according to the invention are basic compounds of the general formula VII

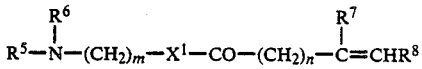

(VII)

and/or amides of the general formula VIII

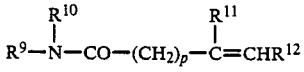

(VIII)

and/or N-vinylaceylamides of the general formula IX

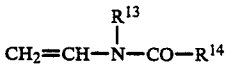

(IX)

and/or ammonium coupounds of the general formula X

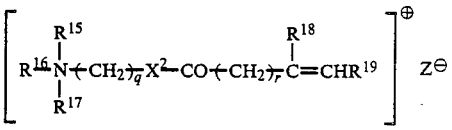

(X)

and/or acrylic esters or methacrylic esters of the general formula XI

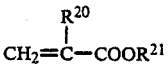

(XI)

wherein $R^5$, $R^6$ *and* $R^{21}$ denote $(C_1-C_{10})$alkyl, $R^7$, $R^8$, $R^{11}$, $R^{12}$, $R^{18}$, $R^{19}$ and $R^{20}$ denote hydrogen or methyl, $R^9$, $R^{10}$ an $R^{13}$ denote hydrogen or $(C_1-C_8)$alkyl, $R^{14}$, $R^{15}$, $R^{16}$ and $R^{17}$ denote $(C_1-C_8)$alkyl, or $R^{13}$ and $R^{14}$ together denote $-(CH_2)_3-$, $-(CH_2)_4-$or $-(CH_2)_5-$, $X^1$ and $X^2$ denote —NH—or —O—, $Z^{\ominus}$ denotes a monovalent anion or a portion of a polyvalent anion equivalent to a monovalent anion, m and q denote one of the numbers 2, 3, 4, 5, 6, 7, 8, 9 and 10 and n, p and r denote one of the numbers 0, 1, 2 and 3.

All the alkyl radicals in the above formulae VII to XI can be straight-chain or branched and preferably have 1 to 4C atoms. $Z^{\ominus}$ can have one of the meanings given for $Y^{\ominus}$ and is preferably identical to $Y^{\ominus}$.

$X^1$ and $X^2$ preferably represent —NH—.

A polymer which can be prepared by polymerization of (a) a diallylammonium component A of the formula I and (b) an amide component B, which consists of a basic component $B^1$ of the formula VII and/or an amide component $B^2$ of the formula VIII and/or an N-vinylacylamide component $B^3$ of the formula IX and/or an ammonium component $B^4$ of the formula X and (c) a (meth)acrylic ester component C of the formula XI in a molar ratio of A:B:C = 1:(0 to 4.5):(0 to 0.5), preferably in a molar ratio of A : B:C = 1:(0.002 to 4.5):(0 to 0.5) is preferably used in the process according to the invention.

The water-soluble polymers used in the process according to the invention can also be crosslinked. To prepare such water-soluble crosslinked polymers, it is advantageous to crosslink a copolymer with a copolymerized component $B^1$ of the formula VII after the copolymerization, by reaction with (d) a polyfunctional alkylating component D and (e) polyamine component E, which consists of a polyamine component $E^1$ of the formula XII $$H_2N-(CH_2)_s-\left[NH-(CH_2)_s-\underset{\underset{T}{|}}{N}-(CH_2)_s\right]_t-NH_2 \quad \text{(XII)}$$

and/or a polyamine component $E^2$ of the formula XIII $$HOOC-R^{22}-CO-NH-(CH_2)_u-NH(CH_2)_u-NH_wR^{23}$$

in a molar ratio of $B^1$:E:D = 1:(0 to 5):(0.002 to 2). $R^{22}$ here denotes an alkylene radical with 1 to 8C atoms or phenylene, $R^{23}$ denotes hydrogen or the radical $-CO-R^{22}-COOH$, T denotes $(CH_2)_s-NH_vH$, w denotes one of the numbers 0, 1, 2 or 3, s and u denote one of the numbers 2, 3, 4 or 5, v denotes the number 0 or a number such that the polyamine component $E^1$ has a molecular weight of 1,000 to 30,000, taking into account t, and t denotes a number such that the molecular weight of the polyamine component $E^1$ of the formula XII is between 1,000 and 30,000, taking into account v.

In the preparation of polymers which are preferably to be employed in the process according to the invention, the diallylammonium component A can consist of a compound of the formula I or of several compounds of the formula I. The other components B, $B^1$, $B^2$, $B^3$, $B^4$, C, D, $E^1$ and $E^2$ can also in each case consist of one compound or of several compounds. The amide component B can consist of an amide component $B^1$ or of an amide component $B^2$ or of an N-vinylacylamide component $B^3$ or of an ammonium component $B^4$. However, the amide component B can also consist, for example, of two individual components (for example $B^1+B^2$, $B^1+B^3$, $B^2+B^3$ or $B^3+B^4$) or, for example, of three individual components (for example $B^1+B^2+B^3$ or $B^1+B^3+B^4$). The amide component B can also contain, however, all four, individual components ($B^1+B^2+B^3+B^4$). In all the cases mentioned, the individual components $B^1$, $B^2$, $B^3$ and $B^4$ in turn consist of one or more individual compounds of the formulae shown.

In the formula VII for the basic component $B^1$, X preferably denotes —NH—, n preferably denotes the number 0 and m preferably denotes one of the numbers 2, 3 or 4. $R^5$ and $R^6$ can be identical or different and preferably denote $(C_1-C_4)$alkyl. $R^7$ and $R^8$ can likewise be identical or different. Examples of particularly preferred compounds of the formula VII are:

$$R^5-\overset{\overset{R^6}{|}}{N}-(CH_2)_m-NH-CO-CH=CH_2 \quad \text{(VIIa)}$$

$$R^5-\overset{\overset{R^6}{|}}{N}-(CH_2)_m-NH-CO-CH=CHCH_3 \quad \text{(VIIb)}$$

$$R^5-\overset{\overset{R^6}{|}}{N}-(CH_2)_m-NH-CO-\overset{\overset{CH_3}{|}}{C}=CH_2 \quad \text{(VIIc)}$$

$$R^5-\overset{\overset{R^6}{|}}{N}-(CH_2)_m-NH-CO-\overset{\overset{CH_3}{|}}{C}=CHCH_3 \quad \text{(VIId)}$$

wherein, in the formula VIIa to VIId, $R^5$, $R^6$ and m in particular have the preferred meanings.

In the formula VIII for the amide component $B^2$, p preferably denotes the number 0. $R^9$ and $R^{10}$ on the one hand and $R^{11}$ and $R^{12}$ on the other hand can be identical or different. $R^9$ and $R^{10}$ preferably denote hydrogen or $(C_1-C_4)$alkyl. $R^{11}$ and $R^{12}$ can also be identical or different. Examples of particularly preferred compounds of the formula VIII are:

$$R^9-\overset{\overset{R^{10}}{|}}{N}-CO-CH=CH_2 \quad \text{(VIIIa)}$$

$$R^9-\overset{\overset{R^{10}}{|}}{N}-CO-CH=CHCH_3 \quad \text{(VIIIb)}$$

$$R^9-\overset{\overset{R^{10}}{|}}{N}-CO-\overset{\overset{CH_3}{|}}{C}=CH_2 \quad \text{(VIIIc)}$$

$$R^9-\overset{\overset{R^{10}}{|}}{N}-CO-\overset{\overset{CH_3}{|}}{C}=CHCH_3 \quad \text{(VIIId)}$$

wherein, in the formulae VIIIa to VIIId, $R^9$ and $R^{10}$ in particular have the preferred meanings.

In the formula IX for the N-vinylacylamide component $B^3$, $R^{14}$ preferably denotes $(C_1-C_4)$alkyl. $R^{13}$ preferably denotes hydrogen or $(C_1-C_4)$alkyl. $R^{13}$ and $R^{14}$ together preferably also denote $-(CH_2)_3-$, $-(CH_2)_4-$ or $-(CH_2)_5-$. Examples of preferred compounds of the formula IX are N-vinyl-2-pyrrolidone, N-vinyl-2-piperidinone and N-vinyl-ε-caprolactam.

In the formula X for the ammonium component $B^4$, $X^2$ preferably denotes —NH—. $R^{15}$, $R^{16}$ and $R^{17}$ can be identical or different and preferably denote $(C_1-C_4)$alkyl, especially preferably methyl, and r preferably denotes the number 0 and q preferably denotes one of the numbers 2, 3 or 4.

In the formula XI for the (meth)acrylic ester component C, $R^{21}$ as a rule denotes $(C_1-C_8)$alkyl, preferably $(C_1-C_4)$alkyl. Where $R^{20}$ = hydrogen the compounds of the formula VI are acrylic esters, and where $R^{20}$ = methyl they are methacrylic esters.

The polyfunctional alkylating component D has, for example, the formula XIV $$A-\underset{\underset{(A^2)_x}{|}}{Z}-A^1 \quad \text{(XIV)}$$

wherein x is the number 0, 1, 2 or 3, preferably 0, and A, $A^1$ and $A^2$ are identical or different radicals of the formula $—CH_2A^3$ or an epoxide radical (oxirane radical) of the formulae XVI or XVII

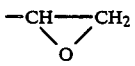

(XVI)

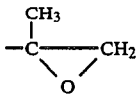

(XVII)

$A^3$ is a substituent which can be split off as an anion, in particular chloride, bromide or iodide, or a group which can be split off as an anion, such as, for example, hydroxyl, a sulphato radical or a phosphato radical, and Z represents a direct bond or represents an (x+2)-valent organic radical. Z can be an aliphatic, aromatic or araliphatic radical, it also being possible for aliphatic and araliphatic radicals to contain keto groups —CO—or hetero atoms, such as —O— or 13 S—, or hetero atom groupings, such as —SO—, $—SO_2—$, —N-H—or $—N(CH_3)—$. In agreement with the preferred meaning of x =0, a divalent radical is preferred for Z, so that a bifunctional alkylating component is preferred as the polyfunctional alkylating component D. Particularly preferred bifunctional alkylating agents correspond to the formula XVIII $$A—Z^1—A^1 \qquad \text{(XVIII)}$$

wherein $Z^1$ represents a direct bond, a phenylene radical, in particular a 1,4-phenylene radical, or a radical of the formula $—(CH_2)_y—$ or $—(CH_2)_k—G—(CH_2)_l—$, wherein y denotes a number from 1 to 6, k and l denote numbers from 1 to 6 and G denotes —O—, —S—, —SO—, $—SO_2—$, —NH—, $—N(CH_3)—$, —CO—, —CHOH— or phenylene, in particular 1,4-phenylene. k and l are preferably identical and preferably denote 1 or 2, in particular 1.

Examples of preferred bifunctional alkylating agents of the formula XVII are: epichlorohydrin (=chloromethyloxirane), epibromohydrin, 1,3-dichloro-propan-2-ol, 2,2'-dichloro-diethyl ether, 2,2'-dichloro-diethylamine, 2,2'-dichloro-diethyl sulphide, 2,2'-dichloro-diethyl sulphoxide, 2,2'-dichloro-diethyl sulphone, 2,2'-bis-(sulphato)-ethyl ether, 2,2'-bis-(phenylsulphonyloxy)ethyl ether, 2,2'-bis-(p-tolylsulphonyloxy)-ethyl ether, diepoxy-butane, di-epoxy-2-methylbutane, bis-glycidylamine (=bis(2,3-epoxy-propyl)-amine), 1,2- or 1,4-bis-(epoxyethyl)-benzene, 1,2- or 1,4-bis-(2,3-epoxy-propyl)-benzene and 1,2- or 1,4-bis(chloromethyl)-benzene.

The polyamine component E can consist of a component $E^1$ or $E^2$ or of the two components $E^1$ and $E^2$.

In the formula XII of the polyamine component $E^1$, s preferably denotes the number 2. In this case, preferred suitable representatives of the polyamine component $E^1$ of the formula XII are commercially available polyethyleneimines with a molecular weight of between 2,000 and 27,000, preferably between 2,000 and 20,000 and particularly preferably between 2,000 and 5,000. Such polyethyleneimines are commercially available. They are prepared by polymerization of ethyleneimine and contain about 50 to 600 ethyleneimine units and usually primary, secondary and tertiary nitrogen atoms in a numerical ratio of about 1:2:1. The various nitrogen atoms are distributed randomly in the molecule. In the process for the preparation of the crosslinked copolymers, they are preferably used directly in the form of their commercially available aqueous solutions.

In the polyamine component $E^2$ of the formula XIII, the alkylene radical $R^{22}$ can be branched or, preferably, straight-chain. A phenylene radical $R^{22}$ is preferably a 1,4- or 1,2-phenylene radical. The compounds of the formula XIII are reaction products of amines of the formula XIX $$H_2N—(CH_2)_u—NH\left[(CH_2)_u—NH\right]_wH \qquad \text{(XIX)}$$

with dicarboxylic acids of the formula XX $$HOOC—R^{22}—COOH \qquad \text{(XX)}$$

in a molar ratio of 1:(0.5 to 1). u preferably denotes 2 or 3 and w preferably denotes 1, 2 or 3. Preferred amines of the formula XIX are, for example:

$H_2N—CH_2—CH_2—NH—CH_2—CH_2—NH_2$, $H_2N—CH_2—CH_2—CH_2—NH—CH_2—CH_2—CH_2—NH_2$, $H_2N—CH_2—CH_2—NH—CH_2—CH_2—NH—CH_2—CH_2—CH_2—NH_2$, $H_2N—CH_2—CH_2—NH—CH_2—CH_2—NH—CH_2—CH_2—NH—CH_2—CH_2—NH_2$.

Suitable dicarboxylic acids of the formula XX are, for example, oxalic acid, malonic acid, succinic acid, glutaric acid, adipic acid, pimelic acid, suberic acid, azelaic acid, sebacic acid, phthalic acid and isophthalic acid.

In a preferred copolymer, the molar ratio of A:B:C is 1:(0.02 to 2.5) : 0. In a preferred crosslinked copolymer, the molar ratio of $B^1$:E:D is 1:(0.05 to 10):(0.002 to 1), preferably 1:(0.1 to 5):(0.01 to 1).

The starting components required for preparation of the polymers and copolymers are known or can be prepared by processes which are known for the particular class of substance.

The preparation of the water-soluble polymers and copolymers used according to the invention by polymerization or copolymerization, in particular by homopolymerization of the diallyl component A or copolymerization of the diallyl component A, the amide component B and the (meth)acrylic ester component C, is carried out in a suitable solvent. Suitable solvents are water, mixed with a water-miscible solvent. Suitable water-miscible solvents are, for example, lower alcohols, such as, for example, methanol, ethanol, n-propanol, i-propanol, n-butanol and tert.-butanol, glycols and diols, such as, for example, ethylene glycol, propylene glycol and 1,3-propanediol, di- and polyglycols, such as, for example, diethylene glycol and triethylene glycol, glycol ethers, such as, for example, diethylene glycol monomethyl ether, diethylene glycol monoethyl ether, ethylene glycol monomethyl ether, ethylene glycol monoethyl ether, ethylene glycol mono-n-propyl ether, ethylene glycol mono-n-butyl ether, ethylene glycol dimethyl ether and ethylene glycol diethyl ether, and ketones, such as, for example, acetone or methyl ethyl ketone. Alcohols with 1 to 4 C atoms are preferred.

The homo- or copolymerization can also be carried out in a mixture of different solvents, preferably in a solvent mixture which contains small amounts of water.

If, for example, the diallylammonium component A is used in the form of an aqueous solution, further addition of water is usually not necessary.

Homo- or copolymerization in pure water usually does not lead to good products. Water mixed with alcohols, in particular those with 1 to 4 C atoms, and mixed with diols or glycols is preferred.

Before the start of the homo- or copolymerization, it is advantageous to bring the pH to values of 3 to 8.5. An acid, preferably an organic acid, in particular acetic acid, is as a rule used for this adjustment of the pH.

The homo- or copolymerization is carried out at temperatures of 40° to 100° C., preferably 60° to 90° C. and especially preferably at temperatures of 65° to 85° C., and is started in the customary manner, for example by addition of suitable initiators. Suitable initiators are substances which form free radicals, such as, for example, benzoyl peroxide, tert.-butyl hydroperoxide, cumene peroxide, methyl ethyl ketone peroxide, lauryl peroxide, tert.-butyl perbenzoate, di-tert.-butyl perphthalate, azodiisobutyronitrile, 2,2'-azobis-(2,4-dimethylvaleronitrile), 2-phenyl-azo-2,4-dimethyl-4-methoxyvaleronitrile, 2-cyano-2-propyl-azoformamide, azodiisobutyramide, dimethyl, diethyl or di-n-butyl azobismethylvalerate, tert.-butyl perneodecanoate, diisononanoyl peroxide, tert.-amyl perpivalate, di-2-ethylhexyl peroxydicarbonate, dilauroyl peroxide, di-isotridecyl peroxydicarbonate and tert.-butyl peroxyisopropyl percarbonate. 2,2'-Azobis-(2-amidino-propane) dihydrochloride, 2,2'-azobis-(2-imidazol- 2-yl-propane) dihydrochloride, 2,2'-azobis-(2-carbamoylpropane) dihydrate or 2,2'-azobis-(2-methoxycarbonyl-propane) is preferably used as the initiator. 0.01 to 2% by weight, preferably 0.1 to 1% by weight, of initiator is used, based on the monomer amount of components A+B+C. It is advantageous to carry out the copolymerization with exclusion of oxygen. This can be effected in a manner which is known per se, for example by flushing with or passing through an inert gas, such as, for example, nitrogen. Components A, B and C, which in each case can consist of one or more individual components, are employed in amounts such that the finished polymer contains at least 16⅔ mol %, preferably at least 40 mol % and especially preferably at least 80 mol %, of units of a compound of the formula I in copolymerized form, the molar ratio of A:B:C preferably being 1:(0 to 4.5):(0 to 0.5), preferably 1: (0.02 to 2.5):0.

The homo- or copolymerization has ended after about 30 minutes to about 4 hours, and in many cases after 30 minutes to 2½ hours.

Water-soluble copolymers which are preferred are those which are prepared using an amide component B consisting of a basic component $B^1$ of the formula IV or containing such a basic component $B^1$, especially if these copolymers have also been subjected to a crosslinking reaction after the copolymerization. The compounds of the formulae IIIa to IIId are preferred here as the basic component $B^1$.

To carry out the crosslinking reaction, the solution obtained in the copolymerization is reacted in the presence of water with a polyfunctional alkylating component D and preferably additionally with a polyamine component E. The polyamine component E can thereby consist of a polyamine component $E^1$ or $E^2$ or of a mixture of these components. If a polyamine component E is used in the crosslinking, it is added to the aqueous solution of the copolymer to be crosslinked before the polyfunctional alkylating component D is added. The molar ratio of $B^1$:D:E in the crosslinking reaction, per mol of basic component $B^1$ copolymerized in the non-crosslinked copolymer, is 1:(0.002 to 2):(0 to 5), preferably 1: (0.002 to 1):(0.05 to 5), and particularly preferably 1: (0.01 to 1):(0.1 to 4.5). The crosslinking is carried out at temperatures of 30° to 90° C., preferably 40° to 60° C., and is ended after only a few minutes, for example 5 to 20 minutes, preferably 5 to 10 minutes, by addition of a mineral acid, such as, for example, hydrochloric acid, sulphuric acid, phosphoric acid or nitric acid. The pH is thereby brought to 4 to 7 by the addition of the mineral acid.

The solutions of the non-crosslinked or crosslinked homoor copolymer which are obtained in the preparation have an active compound content of about 15 to 55% by weight and can be used as textile auxiliaries in the process according to the invention directly in this form, but preferably after dilution to an active compound content of about 25 to 35% by weight. Frequently, however, the pH is brought to values of 3 to 8.5, preferably 7 to 8, before use as a textile auxiliary. A strong acid, such as, for example, hydrochloric acid, sulphuric acid, phosphoric acid or nitric acid, is usually employed for this pH adjustment.

The solutions of the crosslinked or non-crosslinked homoor copolymers obtained in the preparation can be dissolved in water to give either true but at least colloidal solutions.

The process according to the invention is suitable for improving the wet-fastness prcperties, in particular for improving the fastness to washing, of dyeings on cellulose of sulphur dye-stuffs which, in the Colour Index, bear the designations "Sulphur", "Leuco Sulphur" or "Solubilised Sulphur" in their name. The process according to the invention is particularly suitable for the following sulphur dyestuffs: C.I. Sulphur Black 1, C.I. No. 53185; C. I. Sulphur Black 2, C.I. No 53195; C.I. Sulphur Black 18; C.I. Sulphur Blue 1, C.I. No. 53235; C..I. Sulphur Blue 3, C.I. No. 53235; C.I. Sulphur Blue 4, C.I. No. 532,35; C.I. Sulphur Blue 5, C.I. No. 53235; C.I.. Sulphur Blue 11, C.I. No. 53235; C.I. Sulphur Green 2, C.I. No. 53571; C.I. Sulphur Green 36; C.I. Sulphur Brown 46, C.I. No. 53015 and C.I. Sulphur Brown 31, C.I. No. 53280.

The process according to the invention is also particularly suitable for the leuco and solubilized forms of the dyestuffs mentioned above by name, which are listed in the Colour Index under C.I. Leuco Sulphur Black 1 and the like or C.I. Solubilised Sulphur Black 1 and the like.

The process according to the invention is especially suitable for the sulphur dyestuffs C.I. Sulphur Black 1, C.I. No. 53185; C.I. Sulphur Black 2., C.I. No. 53195; C.I. Sulphur Blue 1, C.I: No. 53235; C.I Sulphur Blue 3, C.I. No. 53235; C.I. Sulphur Blue 4, C.I. No. 53235; C.I. Sulphur Blue 5, C. I. No. 53235; C.I. Sulphur Blue 11, C.I. No. 53235 and for the corresponding C.I. Leuco and C.I. Solubilised forms.

In the process according to the invention, the polymer to be used according to the invention is applied to the cellulose before, during or after the dyeing operation. The actual dyeing with the sulphur dyestuffs is thereby carried out in a manner which is known per se by the exhaustion process or a semi-continuous or completely continuous process. The sulphur dyestuff is thereby applied in reduced form, that is to say in the leuco form, to the cellulose and is then oxidized in a suitable manner, which as a rule is carried out by using a particular oxidation bath.

Insoluble sulphur dyestuffs are as a rule dissolved by boiling up with sodium sulphide. Differant reducing agents can also be used entirely or in part instead of sodium sulphide, thus, for example, hydrogen sulphides, alkali and dithionites, alkali and glucose, alkali and mercapto compounds, alkali and thiourea dioxide and alkali and hydroxyacetone.

Cellulose can be dyed with sulphur dyestuffs in all the processing states. Yarn, flocks and slubbing are dyed, for example, on apparatuses in which the liquor circulates. Tricot goods are dyed on a winch vat, and knitted goods are dyed on a jigger, a winch vat or semi-continuously by the pad batch-up process, on pad roll units or by the cold batch process. Completely continuous dyeing is possible by the one-bath process (padding liquor contains reduced dyestuff) or by the two-bath process (1st padding liquor contains dispersed or dissolved dyestuff, 2nd padding liquor contains the reducing agent). The dyestuff is then fixed in a steamer (pad-steam process), but fixing can also take place in an air passage or in compartments of a washing machine.

The process according to the invention is also suitable for the cellulose content of mixtures of cellulose with other fibres, in particular polyesters.

The oxidation of the leuco dyestuffs can be carried out with various oxidizing agents known per se for this purpose, thus, for example, with bichromate/acetic acid, with alkaline hypochlorite solution, with bromate, if appropriate with the addition of metavanadate, or with hydrogen peroxide in the alkaline or acid region. All the known oxidizing agents can be used in the process according to the invention. In the case of C.I. Sulphur Black 1 and 2, however, the oxidation is preferably carried out with hydrogen peroxide in the alkaline range, which offers various advantages over oxidation with hydrogen peroxide in the acid range, for example the fact that it can be carried out at a lower temperature (for example 40° C. instead of 70° C.), without an odour nuisance and without pH-controlled metering-in of acid.

The polymer used is applied to the cellulose in amounts of 0.001 to 5%, preferably 0.01 to 2.5% and especially preferably in amounts of 0.01 to 1.0%, based on the weight of cellulose and calculated on 100% polymer. This application can be carried out in various ways, for example by dipping, spraying, padding, slop-padding and the like.

If the polymer is used during the dyeing operation, it is added, for example, to the oxidation bath.

It can also be applied to the substrate between the dyebath and oxidation bath, after a rinsing operation.

When applied after the dyeing operation, the polymer can be applied after the oxidation bath and before rinsing, after rinsing or after drying. Application before the dyeing operation is also suitable.

By using the polymer which contains 16⅔ to 100 mol % of a compound of the formula I in copolymerized form, a considerable improvement in fastness is achieved during washing. Thus, for example, the staining of cotton and acetate in a wash at 60° C. is improved by 1 to 3 grades. If the polymer is used before the actual dyeing operation, not only an improvement in the fastnesses to washing but also a deepening in colour occurs. The damage to the fibre which occurs with C.I. Sulphur Black 1 and 2 is also reduced, regardless of whether the polymer is applied to the cellulose before, during or after the dyeing operation.

The advantages mentioned are on principle achieved if the polymer is applied in the form of, for example, the solution brought to 20% strength by weight, in an application amount of 0.005 to 25%, preferably 0.05 to 12.5% and in particular 0.05 to 5%, of the weight of the goods. The treatment is advantageously carried out at temperatures from room temperature to 100° C., preferably to 70° C. and particularly preferably at room temperature to 40° C. With an after-treatment, rinsing no longer has to be carried out. A clear improvement in the wet-fastness properties is achieved.

The process according to the invention can also be used in the context of simultaneous as it were one-bath sizing and dyeing of cellulose materials with sulphur dyestuffs. The polymer is thereby added in the form of the approximately 25 to 55% strength by weight solution obtained during the preparation to the sizing dye liquors, as a rule in amounts of 20 to 80 g/l, preferably 30 to 60 g/l. Although addition of a higher amount is possible here, it is as a rule not necessary. Amounts added which are lower than those quoted may also be sufficient in individual cases, for example if very light shades are to be dyed or the requirements on the improvement in fastness properties are not so high. This as it were one-bath sizing dyeing process using the polymer is carried out by the sizing and sizing dyeing processes which are already known per se and in the units suitable for this. Thus, the fibre material to be processed is passed consecutively through the impregnating troughs of the unit and then dried and passed to the fibre store of the further processing machinery. Air passages of varying length are usually incorporated between the impregnating troughs of the sizing dyeing unit, their length being chosen in a known manner such that the dyeing time required for the dyestuff used is achieved. Drying of the yarn impregnated in the impregnating troughs is achieved by supplying heat, as a rule by contact heat via drying rolls, and in general brings the dyeing process to completion and leads to a complete fixing of the dyestuff on the substrate. In carrying out the as it were one-bath sizing dyeing process using the copolymer according to the invention, it is of particular advantage if a fourth impregnating trough is incorporated instead of the 3 impregnating troughs usual in most units. The impregnating troughs are charged with the Sizing dyeing liquor in a manner which is customary per se, the concentration of the sizing agent in the liquor depending on the amount of size required to be applied for the further processing operation and according to the nature of the fibre. For a given liquor pick-up, which is usually between 100 and 200%, the dyestuff concentration depends on the desired depth of colour. The liquors as a rule contain 30 to 80 g per liter of sizing agent and 10 to 50 g per liter of the dyestuff. It is advantageous here for the dyestuff concentration in the first impregnating trough to be somewhat higher than in the subsequent troughs, and ip return for the concentration of the sizing agent in the last troughs to be higher than in the preceding troughs. If 4 impregnating troughs are used, it is advantageous to operate the 4th impregnating trough without the addition of dyestuff. Advantageously, the concentration of the polymer is kept somewhat lower in the baths with higher dyestuff concentrations and a somewhat higher auxiliary concentration is used in baths which have lower dyestuff concentrations. The auxiliary concentrations are thus preferably adjusted to between 0 and 20 g/l in the first bath and the range from 20 to 60 g/l in the last bath.

Possible sizing agents are all the products which are usually employed, such as, for example, starch and starch derivatives, sizing agents based on carboxymethylcellulose, vinyl homoor copolymers, acrylate copolymers or water-soluble polyesters. The agents which are particularly suitable for cellulose materials are preferably used, in particular those based on starch and starch derivatives and carboxymethylcellulose. Starch and starch derivatives are particularly preferred sizing agents.

The sulphur dyestuffs are added to the sizing dye liquors in their reduced and thus water-soluble form.

In addition to the vatted or reduced dyestuffs, the known sizing agents and the fastness-improving polymer to be employed according to the invention, the sizing dye liquors can also contain other auxiliaries and additives which are known from customary dyeing processes. In particular, it is advantageous to add known dyeing accelerators and wetting and dispersing agents to the liquors in the customary concentrations. If necessary, reducing agents which prevent reoxidation of the vatted dyestuffs can furthermore also be added.

By using the polymer, not only is a very considerable improvement in the wet-fastness properties of the sized dyeings achieved, but moreover an improved sizing of the yarn due to better film formation of the sizing agent also results. Finally, an increased beneficial effect on weaving is also to be found.

Homo- or copolymers of diallyl-dimethyl-ammonium chloride are already known for pre- or after-treatment of dyeings with reactive dyestuffs and for after-treatment of dyeings with vat dyestuffs.

It is known from Japanese Published Specification No. 78/134,974 of Toyobo KK that a diallyl-dimethyl-ammonium-sulphur dioxide copoylmer can be used for the after-treatment of dyeings with reactive dyestuffs.

According to Japanese Published Specification No. 82/210,083 of Nikka Kagaku Kogyo, textile materials dyed. with reactive dyestuffs are treated, inter alia, with a diallyl-dimethyl-ammonium chloride homopolymer.

It is known from Japanese Published Specification No. 82/011,288 of Nippon Senka KK that the exhaustion of reactive dyestuffs in textile printing can be improved if pre-treatment is carried out with a copolymer containing copolymerized diallyldimethyl-ammonium halide.

It is known from Japanese Published Specification No. 81/128,382 of Nippon Senka KK that textiles dyed with reactive dyestuffs can be treated with homopolymers of dimethyl-diallyl-ammonium chloride or copolymers of dimethyl-diallyl-ammonium chloride and an acrylamide monomer in a molar ratio of 1:<0.5 in order thereby to improve, for example, the fastness to washing.

It is known from Japanese Published Specification No. 80/076,177 of Nitto Senryo Kokyo that dyeings of vat dyestuffs can be treated with a solution containing, for example, a diallyldimethyl-ammonium chloride.

The known prior art cannot $uggest the invention, since polymers of diallyl-dimethyl-ammonium chloride do not give distinct effects which improve fastness properties on after-treatment of dyeings with sulphur vat dyestuffs (in particular with C.I. Vat Blue 43 and 47 with the C.I. constitution number 53630, which can be used for dyeing on cellulose both as vat dyestuffs with alkali and dithionite and as sulphur dyestuffs with sulphide).

Examples 1 to 5 relate to the preparation of suitable homo- and copolymers. Unless indicated otherwise, the percentages mentioned in the examples are percentages by weight.

Example 1

245 g of ethanol are taken in a 1 liter 4-necked flask which has a reflux condenser, thermometer, gas inlet tube, dropping funnel and anchor stirrer and is in a heating bath, 326.5 g of a 60% strength aqueous solution of dimethyl-diallyl-ammonium chloride (1.2 mol) are added and the mixture is stirred at 20° C. for 10 minutes and brought to a pH of 3.5 with 17.1 g of glacial acetic acid. 0.4 g of 2,2'-azobis-(2-amidinopropane) dihydrochloride are then added and the bath is heated to 80°-8520 C. in the course of 2 hours, while passing in nitrogen. The polymerization starts at an internal temperature of 80° C. and has ended within 30 minutes. The bath is now after-heated at a temperature of 85° C. for 2 hours and the polymerization is brought to completion. The degree of conversion and hence the relative molecular weight are determined by measuring the K value before and after the polymerization.

K value (1% strength aqueous solution)

Before polymerization: $9.0\times10^3$ at 25° C.

After polymerization: $19.4\times10^3$ at 25° C.

EXAMPLE 2

245 g of ethanol are taken in a 1 liter 4-necked flask with a reflux condenser, thermometer, gas inlet tube, dropping funnel and anchor stirrer, and 316.5 g of a 60% strength aqueous solution of dimethyl-diallylammonium chloride (1.17 mol) are added. The mixture is then stirred at 20°-25° C. for 15 minutes, 10 g (0.14 mol) of acrylamide are added and the mixture is stirred again for 10 minutes. After the pH has been brought to 4.0 with 18 g of glacial acetic acid, 0.5 g of 2,2'-azobis-(2-amidinopropane) dihydrochloride are added and the mixture is heated to 80°-85° C. in the course of 30 minutes, while passing in nitrogen. When the polymerization has ended, the mixture is then subsequently stirred at between 80° and 85° C. for a further 2 hours and the K value is determined.

K value (measured as a 1% strength aqueous solution)

Before polymerization: $16.8\times10^3$ at 25° C.

After polymerization: $25.5\times10^3$ at 25° C.

EXAMPLE 3

113.8 g of $H_2O$, 78.5 g of iso-propanol and 235.5 g of a 60% strength aqueous solution of dimethyl-diallyl-ammonium chloride (0.877 mol) are taken in a 1 liter 4-necked flask with a reflux condenser, thermometer, gas inlet tube, dropping funnel and anchor stirrer and are stirred with one another at 25° C. for 10 minutes, 15.7 g (0.092 mol) of N,N-dimethylaminopropyl-methacrylamide are then also added and the pH of the resulting homogeneous solution is brought to pH 8-8.5 with 5.3 g of glacial acetic acid. 0.31 g of 2,2'-azobis-(2-amidinopropane) dihydrochloride are now added, the mixture is heated to the polymerization temperature of 80°-85° C. in the course of 20 minutes and the polymerization is brought to completion in a further 30 minutes. The mixture is then subsequently stirred for 2 hours and brought to a content of 22.5% with 243 g of water.

The degree of conversion is determined by measuring the K value, which is measured in 1% strength aqueous solution.

K value (measured as a 1% strength aqueous solution)

Before polymerization: $12.8\times10^3$ at 25° C.
After polymerization: $29.0\times10^3$ at 25° C.

EXAMPLE 4

113.8 g of $H_2O$, 78.5 g of i-propanol and 235.5 g of a 60% strength aqueous solution of dimethyl-diallylammonium chloride (0.877 mol) are taken in a 1 liter 4-necked flask with a reflux condenser, thermometer, gas inlet tube, dropping funnel and anchor stirrer, 15.7 g (0.092 mol) of dimethylaminopropylmethacrylamide are added and the pH is brought to 8.0–8.5 with 5.3 g of glacial acetic acid. 0.31 g of 2,2'-azobis-(2-amidinopropane) dihydrochloride are now added, nitrogen is passed in and the mixture is heated to 80°–85° C. in the course of 20 minutes. After 15 minutes, the polymerization has ended. The mixture is now subsequently stirred for 2 hours. 16.8 g of a 5% strength solution of 0.8415 g (0.0091 mol) of epichlorohydrin in ethanol are now added, crosslinking is carried out at 40°–50° C. for 10 minutes, the pH is then brought to 7.6 with 1.3 g of sulphuric acid and the mixture is subsequently brought to an active compound concentration of 22.5% with 225.6 g of water.

The degree of conversion is determined by measuring the K values.

K value (measured as a 1% strength aqueous solution)
Before polymerization: $12.8\times10^3$ at 25° C.
After polymerization: $33\times10^3$ at 25° C.

EXAMPLE 5

113.8 g of $H_2O$, 78.5 g of iso-propanol and 235.5 g of a 60% strength aqueous solution of dimethyldiallylammonium chloride (0.877 mol) and 15.7 g (0.092 mol) of N,N-dimethylaminopropyl methacrylamide are taken in a 1 liter 4-necked flask with a reflux condenser, thermometer, gas inlet tube, dropping funnel and anchor stirrer, the pH is then brought to 8.5 with 5.0 g of glacial acetic acid, 0.31 g of 2,2'-azobis-(2-amidinopropane) dihydrochloride are added and the mixture is heated to 80° C. in the course of 20 minutes, while passing in nitrogen. Polymerization is carried out at 80°–85° C. for 30 minutes and the mixture is subsequently stirred at 80° C. for 2 hours.

34.88 g of a 50% strength polyethyleneimine solution and 47.1 g of water are now added, the mixture is stirred at 40°–45° C. for 15 minutes, 16.8 g of 5% strength ethanolic epichlorohydrin solution are added at this temperature, and after 15 minutes the pH is brought to 6.5 with 10.1 g of sulphuric acid and the mixture is subsequently diluted with 290.3 g of water to give a polymer content of 20%.

K value before polymerization: $18.77\times10^3$ at 25° C.
K value after polymerization: $31.25\times10^3$ at 25° C.
K value after addition of polyethyleneimine: $33.8\times10^3$ at 25° C.
K value after crosslinking with epichlorohydrin: $40.5\times10^3$ at 25° C.

The following Examples 6 to 32 relate to the process according to the invention. The following washing fastness tests 1 to 4 are used to test the dyeings:

Washing fastness test 1

Fastness testing is carried out in accordance with International Standard ISO 105-C 03-1982(E), colour fastness to washing: Test 3, with the following amendment:

Instead of two non-dyed individual fibre concomitant fabrics, a 100 mm×40 mm multiple fibre concomitant fabric with sections of acetate, cotton, polyamide, polyester, polyacrylic and wool is used.

Washing fastness test 2

Fastness testing is carried out in accordance with washing fastness test 1 with the difference that the washing is carried out five times with a new wash liquor each time, before the evaluation.

Washing fastness test 3

Fastness testing is carried out in accordance with International Standard ISO 105-C 04-1982(E), colour fastness to washing: test 4, with the following amendment:

Instead of two non-dyed individual fibre concomitant fabrics, a 100 mm×40 mm multiple fibre concomitant fabric with sections of acetate, cotton, polyamide, polyester, polyacrylic and wool is used.

Washing fastness test 4

Fastness testing is carried out in accordance with International Standard ISO 105-C 03-1982(E), colour fastness to washing: test 3, with the following amendments:

Instead of two non-dyed individual fibre concomitant fabrics, a 100 mm×40 mm multiple fibre concomitant fabric with sections of acetate, cotton, polyamide, polyester, polyacrylic and wool is used.

Instead of 5 g of soap, 4 g of ECE colour fastness test washing agent without optical brightener are used per liter of distilled water.

Instead of 2 g of sodium carbonate, 1 g of sodium perborate ($NaBO_2.H_2O_2.3H_2O$) is used per liter of distilled water.

EXAMPLE 6

The dyestuff C.I. Solubilised Sulphur Black 1 is introduced into a cylindrical stainless steel container which has a capacity of 150 ml and can be closed. A number of grams of a commercial product such that a deep black dyeing results is taken. The dyestuff is dissolved in completely demineralized water, and 0.4 g of sodium carbonate, 1.5 times the amount, based on the amount of dyestuff, of a 30% strength aqueous solution of sodium hydrogen sulphide, 0.3 ml of a 43% strength aqueous solution of sodium tetrasulphide and 2 g of sodium sulphate are then added. The volume of the dye liquor is brought to 100 ml by addition of further completely demineralized water.

10 g of cotton fabric are introduced into the liquor and the container is closed and immersed in a hot water-bath at 60° C. The container is moved in the bath. The bath is heated up from 60° C. to 90° C. in the course of 15 minutes and is kept at 90° C. for 60 minutes. The cotton fabric is then removed from the liquor and rinsed thoroughly with completely demineralized water.

The fabric is then immediately introduced into 500 ml of a hot aqueous solution, at 70° C., containing 0.5 g of sodium bromate, 0.025 g of sodium metavanadate, 0.96 g of acetic acid, 0.5 g of sodium acetate and 0.24 g of the product from Preparation Example 1. The fabric is agitated in the oxidation bath at 70° C. for 15 minutes and then removed from the bath, rinsed thoroughly with completely demineralized water and dried at 100° C. The fastness of the dyeing to washing is improved, for example, in washing fastness tests 1, 2 and 4 as regards staining of cotton and acetate in comparison with a dyeing which has been carried out in the same manner but without the product from Preparation Example 1.

EXAMPLE 7

The procedure is the same as in Example 6, with the exception of the oxidation. Instead of oxidation with bromate, oxidation is carried out with hydrogen peroxide as follows: the fabric is then introduced immediately into 500 ml of a hot aqueous solution, at 70° C., containing 1 ml of a 35% strength aqueous solution of hydrogen peroxide, 0.8 g of acetic acid, 1.25 g of sodium acetate and 0.24 g of the product from Preparation Example 1. The fabric is agitated in the oxidation bath at 70° C. for 15 minutes and is then removed from the bath, rinsed thoroughly with completely demineralized water and dried at 100° C.

The fastness of the dyeing to washing is improved, for example, in washing fastness tests 1, 2 and 4 in respect of staining of cotton and acetate in comparison with a dyeing which has been produced in the same manner but without the product from Preparation Example 1.

EXAMPLE 8

The procedure is the same as in Example 6, with the exception of the oxidation, and instead of the product from Preparation Example 1, the product from Preparation Example 3 is used. Instead of the oxidation with bromate, oxidation is carried out with hydrogen peroxide as follows: the fabric is then introduced immediately into 500 ml of a hot aqueous solution, at 70° C., containing 1 ml of a 35% strength aqueous solution of hydrogen peroxide, 0.8 g of acetic acid, 1.25 g of sodium acetate and 0.36 g of the product from Preparation Example 3. The fabric is agitated in the oxidation bath at 70° C. for 15 minutes and is then removed from the bath, rinsed thoroughly with completely demineralized water and dried at 100° C.

The fastness of the dyeing to washing is improved, for example, in washing fastness tests 1, 2 and 4 in respect of staining of cotton and acetate in comparison with a dyeing which has been produced in the same manner but without the product from Preparation Example 3.

EXAMPLE 9

If 0.36 g of the product from Preparation Example 4 is used in Example 6 instead of the product from Preparation Example 1, a dyeing is obtained which has a fastness to washing which is improved, for example, in washing fastness tests 1, 2 and 4 in respect of staining of cotton and acetate in comparison with a dyeing which has been produced in the same manner but without the product.

EXAMPLE 10

If the dyestuff C.I. Leuco Sulphur Black 2 is used in Example 6 instead of the dyestuff C.I. Solubilised Sulphur Black 1, a dyeing is obtained which has a fastness to washing which is improved in respect of staining of cotton and acetate in comparison with a dyeing which has been produced in the same manner but without the product from Preparation Example 1.

EXAMPLE 11

The dyestuff C.I. Solubilised Sulphur Blue 11 is introduced into a cylindrical stainless steel vessel which has a capacity of 150 ml and can be closed. A number of grams of a commercial product is taken such that a dyeing with a 1/1 standard depth shade results. The dyestuff is dissolved in completely demineralized water and 0.4 g of sodium carbonate, 0.5 ml of a 30% strength aqueous solution of sodium hydrogen sulphide, 0.3 ml of a 43% strength aqueous solution of sodium tetrasulphide and 2 g of sodium sulphate are added. The volume of the dye liquor is brought to 100 ml by addition of further completely demineralized water.

10 g of cotton fabric are introduced into the liquor and the container is closed and immersed in a hot water-bath at 60° C. The container is agitated in the bath. The bath is heated up from 60° C. to 90° C. in the course of 15 minutes and kept at 90° C. for 60 minutes. The cotton fabric is then removed from the liquor and rinsed thoroughly with completely demineralized water.

The fabric is then introduced immediately into 500 ml of a hot aqueous solution, at 70° C., containing 0.5 g of sodium bromate, 0.025 g of sodium metavanadate, 0.96 g of acetic acid, 0.5 g of sodium acetate and 0.24 g of the product from Preparation Example 1. The fabric is agitated in the oxidation bath at 70° C. for 15 minutes and is then removed from the bath, rinsed thoroughly with completely demineralized water and dried at 100° C.

The fastness of the dyeing to washing is improved, for example, in washing fastness tests 1, 2 and 4 in respect of staining of cotton and acetate in comparison with a dyeing which has been produced in the same manner but without the product from Preparation Example 1.

EXAMPLE 12

The procedure is the same as in Example 11, with the exception of the oxidation. Instead of the oxidation with bromate, oxidation is carried out with hydrogen peroxide as follows:

The fabric is then introduced immediately into 500 ml of a hot aqueous solution, at 70° C., containing 1 ml of a 35% strength aqueous solution of hydrogen peroxide, 0.8 g of acetic acid, 1.25 g of sodium acetate and 0.24 g of the product from Preparation Example 1. The fabric is agitated in the oxidation bath at 70° C. for 15 minutes and is then removed from the bath, rinsed thoroughly with completely demineralized water and dried at 100° C.

The fastness of the dyeing to washing is improved, for example, in washing fastness tests 1, 2 and 4 in respect of staining of cotton and acetate in comparison with a dyeing which has been produced in the same manner but without the product from Preparation Example 1.

EXAMPLE 13

If, in Example 11, the dyestuff C.I. Sulphur Blue 11 is used instead of the dyestuff C.I. Solubilised Sulphur Blue 11 and 0.75 g of 60% strength sodium sulphide is used instead of sodium carbonate and sodium hydrogen sulphide, the same result as in Example 11 is obtained.

EXAMPLE 14

If, in Example 11, the dyestuff C.I. Sulphur Blue 1 is used instead of the dyestuff C.I. Solubilised Sulphur Blue 11 and 0.75 g of 60% strength sodium sulphide is used instead of sodium carbonate and sodium hydrogen sulphide, a dyeing is obtained which has a fastness to washing which is improved in respect of staining of cotton and acetate in comparison with a dyeing which has been produced in the same manner but without the product from Preparation Example 1.

EXAMPLE 15

If, in Example 11, the dyestuff C.I. Sulphur Blue 3 is used instead of the dyestuff C.I. Solubilised Sulphur Blue 11 and 0.75 g of 60% strength sodium sulphide is used instead of sodium carbonate and sodium hydrogen sulphide, a dyeing is obtained which has a fastness to washing which is improved in respect of staining of cotton and acetate in comparison with a dyeing which has been produced in the same manner but without the product from Preparation Example 1.

EXAMPLE 16

If, in Example 11, the dyestuff C.I. Solubilized Sulphur Blue 4 is used instead of the dyestuff C.I. Solubilized Sulphur Blue 11, a dyeing is obtained which has a fastness to washing which is improved in respect of staining of cotton and acetate in comparison with a dyeing which has been produced in the same manner but without the product from Preparation Example 1.

EXAMPLE 17

If, in Example 11, the dyestuff C.I. Leuco Sulphur Blue 5 is used instead of the dyestuff C.I. Solubilised Sulphur Blue 11, a dyeing is obtained which has a fastness to washing which is improved in respect of staining of cotton and acetate in comparison with a dyeing which has been produced in the same manner but without the product from Preparation Example 1.

EXAMPLE 18

The dyestuff C.I. Leuco Sulphur Black 1 is mixed with completely demineralized water, 5 ml of a 30% strength aqueous solution of sodium hydrogen sulphide, 5 ml of a 43% strength aqueous solution of sodium tetrasulphide and 5 ml of Leon® KS, an anionic wetting agent from Hoechst AG, in a measuring cylinder and the mixture is made up to 1,000 ml with completely demineralized water. A number of grams of a liquid commercial dyestuff is taken such that a black dyeing results. A cotton fabric is padded on a padder with a liquor pick-up of 80% with the padding liquor prepared in this manner. The padded fabric is immediately introduced into an airless steamer and steamed at 105° C. for 60 seconds. The cotton fabric is then rinsed thoroughly with completely demineralized water and squeezed off to a weight of 178% of the original dry weight. The squeezed-off fabric is immediately padded on a padder with an aqueous solution containing 35 g per liter of the product from Preparation Example 1 and is thereby squeezed off to a weight of 183% of the original dry weight. The fabric treated in this manner is immediately introduced into a hot oxidation bath, at 40° C., containing 3 ml of a 35% strength aqueous hydrogen peroxide solution and 1.5 g of sodium carbonate per liter. After 60 seconds, the fabric is removed from the bath, rinsed thoroughly with completely demineralized water and dried at 100° C.

The fastness of the dyeing to washing is improved, for example, in washing fastness tests 1, 2 and 3 in respect of staining of cotton and acetate in comparison with a dyeing which has been produced in the same manner but without the product from Preparation Example 1.

EXAMPLE 19

The dyestuff C.I. Leuco Sulphur Black 1 is mixed with completely demineralized water, 5 ml of a 30% strength aqueous solution of sodium hydrogen sulphide, 5 ml of a 43% strength aqueous solution of sodium tetrasulphide and 5 ml of Leonil® KS, an anionic wetting agent from Hoechst AG, in a measuring cylinder and the mixture is made up to 1,000 ml with completely demineralized water. A number of grams of a liquid commercial dyestuff is taken such that a black dyeing results. A cotton fabric is padded on a padder with a liquor pick-up of 80% with the padding liquor prepared in this manner. The padded fabric is immediately introduced into an airless steamer and is steamed at 105° C. for 60 seconds. The cotton fabric is then rinsed thoroughly with completely demineralized water and squeezed off to a weight of about 185% of the original dry weight. The squeezed-off fabric is immediately introduced into a hot oxidation bath, at 40° C., containing 3 ml of a 35% strength aqueous hydrogen peroxide solution and 1.5 g of sodium carbonate per liter. After 60 seconds, the fabric is removed from the bath and squeezed off to a weight of 178% of the original dry weight. The squeezed-off fabric is immediately padded on a padder with an aqueous solution containing 35 g of the product from Preparation Example 1 per liter and is thereby squeezed off to a weight of 183% of the original dry weight. The fabric is then rinsed thoroughly th completely demineralized water and dried at 100° C.

The fastness of the dyeing to washing is improved, for example, in washing fastness tests 1 and 2 in respect of staining of cotton and acetate and in washing fastness test 4 in respect of staining of cotton in comparison with a dyeing which has been produced in the same manner but without the product from Preparation Example 1.

EXAMPLE 20

If, in Example 18, 55 g of the product from Preparation Example 5 are used per liter of padding solution instead of the product from Preparation Example 1, a dyeing is obtained which has a fastness to washing which is improved, for example, in washing fastness tests 1, 2 and 3 in respect of staining of cotton and acetate in comparison with a dyeing which has been produced in the same manner but without the product.

EXAMPLE 21

If, in Example 18, 40 g of the product from Preparation Example 2 are used per liter of padding solution instead of the product from Preparation Example 1, a dyeing is obtained which has a fastness to washing which is improved, for example, in washing fastness tests 1, 2 and 3 in respect of staining of cotton and acetate in comparison with a dyeing which has been produced in the same manner but without the product.

EXAMPLE 22

If, in Example 19, 50 g of the product from Preparation Example 4 are used per liter of padding solution instead of the product from Preparation Example 1, a dyeing is obtained which has a fastness to washing which is improved, for example, in washing fastness tests 1 and 2 in respect of staining of cotton and acetate and in washing fastness test 4 in respect of staining of cotton in comparison with a dyeing which has been produced in the same manner but without the product.

EXAMPLE 23

The dyestuff C.I. Solubilised Sulphur Green 2 is introduced into a cylindrical stainless steel container which has a capacity of 150 ml and can be closed. A number of grams of a commercial product is taken such that a dyeing with a 1/1 standard depth of shade results. The dyestuff is dissolved in completely demineralized water and 0.4 g of sodium carbonate, 0.6 ml of a 30% strength aqueous solution of sodium hydrogen sulphide, 0.3 ml of a 43% strength aqueous solution of sodium tetrasulphide and 2 g of sodium sulphate are then added. The volume of the dye liquor is brought to 100 ml by addition of further completely demineralized water.

10 g of cotton fabric are introduced into the liquor and the container is closed and immersed in a hot water-bath at 60° C. The container is agitated in the bath. The bath is heated up from 60° C. to 90° C. in the course of 15 minutes and kept at 90° C. for 60 minutes. The cotton fabric is then removed from the liquor and rinsed thoroughly with completely demineralized water.

The fabric is then introduced immediately into 500 ml of a hot aqueous solution, at 40° C., containing 0.5 ml of a 35% strength aqueous solution of hydrogen peroxide, 0.5 g of sodium carbonate and 0.24 g of the product from Preparation Example 1. The fabric is agitated in the oxidation bath at 40° C. for 15 minutes and is then removed from the bath, rinsed thoroughly with completely demineralized water and dried at 100° C.

The fastness of the dyeing to washing is improved, for example, in washing fastness test 1 in respect of staining of cotton and acetate in comparison with a dyeing which has been produced in the same manner but without the product from Preparation Example 1.

EXAMPLE 24

The dyestuff C.I. Solubilised Sulphur Brown 46 is introduced into a cylindrical stainless steel container which has a capacity of 150 ml and can be closed. A number of grams of a commercial product is taken such that a dyeing with a 1/1 standard depth shade results. The dyestuff is dissolved in completely demineralized water and 0.4 g of sodium carbonate, 0.5 ml of a 30% strength aqueous solution of sodium hydrogen sulphide, 0.3 ml of a 43% strength aqueous solution of sodium tetrasulphide and 2 g of sodium sulphate are added. The volume of the dye liquor is brought to 100 ml by addition of further completely demineralized water.

10 g of cotton fabric are introduced into the liquor and the container is closed and immersed in a hot water-bath at 60° C. The container is agitated in the bath. The bath is heated up from 60° C. to 90° C. in the course of 15 minutes and is kept at 90° C. for 60 minutes. The cotton fabric is then removed from the liquor and rinsed thoroughly with completely demineralized water.

The fabric is then introduced immediately into 500 ml of a hot aqueous solution, at 70° C., containing 0.5 g of sodium bromate, 0.025 g of sodium metavanadate, 0.96 g of acetic acid, 0.5 g of sodium acetate and 0.36 g of the product from Preparation Example 4. The fabric is agitated in the oxidation bath at 70° C. for 15 minutes and is then taken out of the bath, rinsed thoroughly with completely demineralized water and dried at 100° C.

The fastness of the dyeing to washing is improved, for example, in washing fastness tests 1 and 2 in respect of staining of cotton and acetate and in washing fastness test 4 in respect of staining of cotton in comparison with a dyeing which has been produced in the same manner but without the product from Preparation Example 1.

EXAMPLE 25

Cotton fabric is dyed by the pad-steam process with an amount of C.I. Leuco Sulphur Green 36 in one liter of padding liquor such that a dyeing with a 1/1 standard depth shade results. After steaming and rinsing, the fabric is oxidized for 60 seconds in a hot oxidation bath, at 70° C., containing 3 ml of a 35% strength aqueous hydrogen peroxide solution, 1.6 g of acetic acid and 2.5 g of sodium acetate per liter. The fabric is then rinsed in the customary manner and dried at 100° C. The dyed and dried fabric is padded on a padder with a solution consisting of 9 g of the product from Preparation Example 4 and 991 g of completely demineralized water per kg. The liquor pick-up is 80%. The padded fabric is dried at 100° C.

The fastness of the after-treated dyeing to washing is improved, for example, in washing fastness tests 1, 2 and 4 in respect of staining of cotton and acetate in comparison with a dyeing which has been produced in the same manner but without the after-treatment with the product from Preparation Example 4.

EXAMPLE 26

A cotton cord is dyed by the pad-steam process with an amount of C.I. Leuco Sulphur Blue 5 per liter of padding liquor such that a dark dyeing results. After steaming and rinsing, the fabric is oxidized for 60 seconds in a hot oxidation bath, at 70° C., containing 1 g of sodium bromate, 0.05 g of sodium metavanadate, 1.9 g of acetic acid and 1 g of sodium acetate per liter. The fabric is then rinsed in the customary manner and dried at 100° C. The dyed and dried cord fabric is padded on a padder with a solution consisting of 3 g of the product from Preparation Example 1 and 997 g of completely demineralized water per kg. The liquor pick-up is 80%. The padded fabric is dried at 100° C.

The fastness of the after-treated dyeing to washing is improved, for example, in washing fastness tests 1 and 4 in respect of staining of cotton and acetate in comparison with a dyeing which has been produced in the same manner but without the aftertreatment with the product from Preparation Example 1.

EXAMPLE 27

Cotton cord is dyed by the pad-steam process with an amount of C.I. Leuco Sulphur Black 1 per liter of padding liquor such that a deep dark dyeing results. After steaming and rinsing, the fabric is oxidized for 60 seconds in a hot oxidation bath, at 70° C., containing 3 ml of a 35% strength aqueous hydrogen peroxide solution, 1.6 g of acetic acid and 2.5 g of sodium acetate per liter. The fabric is then rinsed in the customary manner and dried at 100° C. The dyed and dried fabric is padded on a padder with a solution which consists of 6 g of the product from Preparation Example 1 and 994 g of completely demineralized water per kg. The liquor pick-up is 80%. The padded fabric is dried at 100° C.

The fastness of the after-treated dyeing to washing is improved, for example, in washing fastness tests 1 to 4 in respect of staining of cotton and acetate in comparison with a dyeing which has been produced in the same manner but without the aftertreatment with the product from Preparation Example 1.

EXAMPLE 28

Dry non-dyed cotton fabric is padded on a padder with a solution consisting of 6 g of the product from Preparation Example 1 and 994 g of completely demineralized water per kg. The liquor pick-up is 80%. The padded fabric is dried at 100° C.

The fabric is then dyed by the pad-steam process with an amount of C.I. Leuco Sulphur Blue 5 per liter of padding liquor such that a dyeing with a 1/1 standard depth shade results. After steaming and rinsing, the fabric is oxidized for 60 seconds in a hot oxidation bath, at 70° C., containing 1 g of sodium bromate, 0.05 g of sodium metavanadate, 1.9 g of acetic acid and 1 g of sodium acetate per liter. The fabric is then rinsed in the customary manner and dried at 100° C.

A good penetration dyeing with good levelness is obtained. The dyeing is considerably deeper than a dyeing which is produced under the same dyeing conditions with the same amount of dyestuff on cotton fabric which has not been pretreated. About 50% more dyestuff is required to achieve the same depth of colour under the same dyeing conditions on the fabric which has not been pretreated.

The fastness of the dyeing on the pretreated fabric to washing is improved, for example, in washing fastness tests 1 to 4 in respect of staining of cotton and acetate in comparison with a dyeing of equal strength which has been produced in the same manner but without the pretreatment with the product from Preparation Example 1.

EXAMPLE 29

Dry non-dyed cotton fabric is padded on a padder with a solution consisting of 6 g of the product from Preparation Example 1 and 994 g of completely demineralized water per kg. The liquor pick-up is 80%. The padded fabric is dried at 100° C.

The fabric is then dyed by the pad-steam process with an amount of C.I. Leuco Sulphur Black 1 per liter of padding liquor such that a medium black dyeing results. After steaming and rinsing, the fabric is oxidized for 60 seconds in a hot oxidation bath, at 70° C., containing 3 ml of a 35% strength aqueous hydrogen peroxide solution, 1.6 g of acetic acid and 2.5 g of sodium acetate per liter. The fabric is then rinsed in the customary manner and dried at 100° C.

A good penetration dyeing with good levelness is obtained. The dyeing is considerably deeper than a dyeing which is produced under the same dyeing conditions with the same amount of dyestuff on cotton fabric which has not been pretreated. About 15% more dyestuff is required to achieve the same depth of colour under the same dyeing conditions on fabric which has not been pretreated.

The fastness of the dyeing on the pretreated fabric to washing is improved, for example, in washing fastness tests 1 to 4 in respect of staining of cotton and acetate in comparison with an equally strong dyeing which has been produced in the same manner but without the pretreatment with the product from Preparation Example 1.

EXAMPLE 30

Cotton is dyed by the pad-steam process with an amount of C.I. Leuco Sulphur Black 1 per liter of padding liquor such that a deep black dyeing results. After steaming and rinsing, the fabric is oxidized for 60 seconds in a hot oxidation bath, at 40° C., containing 3 ml of a 35% strength aqueous hydrogen peroxide solution and 1.5 g of sodium carbonate per liter. The fabric is then rinsed in the customary manner and squeezed off to a weight of 178% of the original dry weight. The squeezed-off fabric is padded wet-on-wet on a padder with an aqueous solution which contains 100 g of the product from Preparation Example 2 per liter and has been brought to pH 10 with sodium carbonate, and is thereby squeezed off to a weight of 183% of the original dry weight. The fabric is then dried at 100° C.

The fastness of the dyeing to washing is improved, for example, in washing fastness test 1 in respect of staining of cotton and acetate and in washing fastness test 4 in respect of staining of cotton in comparison with a dyeing which has been produced in the same manner but without the product from Preparation Example 2.

The ageing of cotton which has been dyed with C.I. Leuco Sulphur Black 1 leads to a considerable reduction in tear strength. In order to accelerate the ageing, the dyed fabric is kept in a steam/air mixture at 100° C. for 24 hours. After this ageing, the tear strength is significantly improved in comparison with a fabric which has been treated in the same manner but without the product from Preparation Example 2.

EXAMPLE 31

Cotton fabric is dyed by the pad-steam process with an amount of C.I. Leuco Sulphur Black 1 per liter of padding liquor such that a deep black dyeing results. After steaming and rinsing, the fabric is oxidized for 60 seconds in a hot oxidation bath, at 40° C., containing 3 ml of a 35% strength aqueous hydrogen peroxide solution and 1.5 g of sodium carbonate per liter. The fabric is then rinsed in the customary manner and dried. The dried fabric is padded on a padder with a liquor pick-up of 80% with a solution which contains 10 g of the product from Preparation Example 5 per liter and has been brought to pH 9 with sodium carbonate, and is then dried at 100° C.

The fastness of the dyeing to washing is improved, for example, in washing fastness test 1 in respect of staining cotton and acetate and in washing fastness test 4 in respect of staining of cotton in comparison with a dyeing which has been produced in the same manner but without the product from Preparation Example 5.

Ageing of cotton which has been dyed with C.I. Leuco Sulphur Black 1 leads to a considerable reduction in tear strength. In order to accelerate the ageing, the dyed fabric is kept in a steam/air mixture at 10020 C. for 24 hours. After this ageing, the tear strength is significantly improved in comparison with a fabric which has been treated in the same manner but without the product from Preparation Example 5.

EXAMPLE 32

If, in Example 31, in each case 6 g of the product from Preparation Example 1 or 7 g of the product from Preparation Example 2 or 9 g of the product from Preparation Example 3 or 9 g of the product from Preparation Example 4 are used per liter of padding solution instead of the product from Preparation Example 5, in each case the same results as stated in Example 31 are obtained.

What is claimed is:

1. A process for improving the wet-fastness properties of cellulose material dyed with at least one sulphur dyestuff selected from the group consisting of C.I. Sulphur Black 1, C.I. No. 53185; C.I. Sulphur Black 2, C.I. No. 53195; C.I. Sulphur Blue 1, C.I. No. 53235; C.I. Blue 3, C.I. No. 53235; C.I. Sulphur Blue 4, C.I. No. 53235; C.I. Suplhur Blue 5, C.I. No. 53235; C.I. Sulphur Blue 11, C.I. No. 53235; and the leuco or solublized forms of such sulphur dyestuffs which comprise treating the cellulose, before, during or after dyeing, with a polymer which is a copolymer or homopolymer of a monomer of the formula (I)

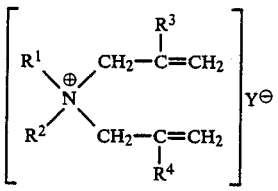

(I)

wherein each $R^1$ and $R^2$ is independent of the other hydrogen, ($C_1$–$C_{22}$) alkyl, ($C_1$–$C_{22}$)hydroxyalkyl, or ($C_1$–$C_{22}$) alkyl interrupted by —CO—NH—or —NH—CO;

each $R^3$ and $R^4$ independent of the other is hydrogen or methyl;

and $Y^{\ominus}$ deontes a monovalent anion or one equivalent of a polyvalent anion.

2. A process according to claim 1 wherein the monomer of the formula (I), $R^1$ and $R^2$ denote ($C_1$–$C_{10}$)alkyl.

3. A process according to claim 1 wherein, the monomer of the formula (I), $R^1$ and $R^2$ denote methyl, $R^3$ and $R^4$ denote hydrogen and $Y^{\ominus}$ denotes a halogen atom.

4. A process according to claim 1 wherein the polymer contains 16.67 to 100 mol % of copolymerized monomers of the formula (I).

5. A process according to claim 1 wherein the polymer contains 40 to 100 mol % of copolymerized monomers of the formula (I).

6. A process according to claim 1 wherein the polymer contains 80 to 100 mol % of copolymerized monomers of the formula (I).

7. A process according to claim 1 wherein the polymer is applied to the cellulose material in amounts of 0.001 to 5%, based on the weight of the cellulose.

8. A process according to claim 7 wherein the amount of polymer applied to the cellulose is 0.01 to 2.5%.

9. A process according to claim 1 wherein the polymer is applied to the cellulose is 0.01 to 1%.

10. A process according to claim 1 wherein the polymer is applied during dyeing in a sizing dyesing process using one-bath sizing and dyeing of cellulose materials with sulphur dyestuffs.

11. A process according to claim 1 wherein the polymer is a copolymer prepared by copolymerization of (A) a diallylammonium component of the formula I;

(B) an amide component which is one or more component $B^1$ of the formula VII

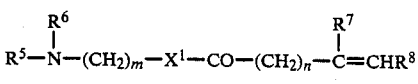

(VII)

component $B^2$ of the formula VIII

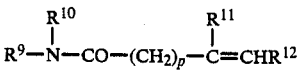

(VIII)

component $B^3$ of the formula IX

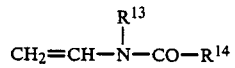

(IX)

component $B^4$ of the formula X

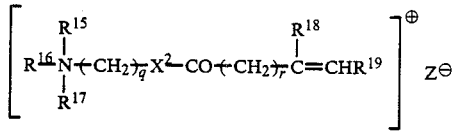

(X)

and (C) a (meth)acrylic ester component of the formula XI

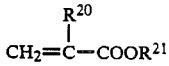

(XI)

in a molar ratio of A:B:C of 1:(0.002 to 4.5):(0 to 0.5), and, wherein $R^5$, $R^6$ and $R^{21}$ denote ($C_1$–$C_{10}$)alkyl;

$R^7$, $R^8$, $R^{11}$, $R^{12}$, $R^{18}$, $R^{19}$ and $R^{20}$ denote hydrogen or methyl;

$R^9$, $R^{10}$ and $R^{13}$ denote hydrogen or ($C_1$–$C_8$)alkyl;

$R^{14}$, $R^{15}$, $R^{16}$ and $R^{17}$ denote ($C_1$–$C_8$)alkyl, $R^{-}$and $R^{14}$ when taken together denote —$(CH_2)_3$—, —$(CH_2)_4$— or —$(CH_2)_5$—;

$X^1$ and $X^2$ are —NH— or —O—;

$Z^{\ominus}$ denotes a monovalent anion or one equivalent of a polyvalent anion;

m and q denote one of hte numbers 2, 3, 4, 5, 6, 7, 8, 9 and 10; and n, p, and r denote one of the numbers 0, 1, 2 or 3.

12. A process according to claim 11 wherein the copolymer contains copolymerized component $B^1$ and the copolymer is crosslinked with (D) a polyfunctional alkylating component and (E) a polyamine component which is at least one polyamine component $E^1$ of the formula XII

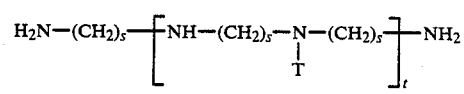

(XII)

or a polyamine component $E^2$ of the formula XIII

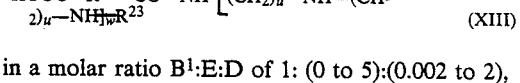

(XIII)

in a molar ratio $B^1$:E:D of 1: (0 to 5):(0.002 to 2), wherein $R^{22}$ is an alkylene with 1 to 8 carbon atoms or phenylene;

$R^{23}$ is hydrogen or —CO—$R^{22}$—COOH;

T is $-[(CH_2)_s-NH]_v-H$ s and ū denote one of the numbers 2, 3, 4 or 5;

w denotes one of the numbers 0, 1, 2 or 3;

v denotes 0 or a sufficiently high number such that the polyamine component $E^1$, taking into account t, has a molecular weight of 1,000 to 30,000 and t denotes a number such that, taking into account v, the molecular weight of the polyamine component $E^1$ of the formula XII is between 1,000 and 30,000.

13. A process according to claim 11 wherein in the copolymer $R^5$, $R^6$, $R^{14}$, $R^{15}$, $R^{16}$ and $R^{17}$ denotes $(C_1-C_4)$alkyl, $R^9$, $R^{10}$ and $R^{13}$ denotes hydrogen or $(C_1-C_4)$alkyl, and n, p and v denote 0.

14. A process according to claim 11 wherein the polymer is applied to the cellulose material in amounts of 0.001 to 5%, based on the weight of the cellulose.

15. A process according to claim 14 wherein the amount of polymer applied to the cellulose is 0.01 to 2.5%.

16. A process according to claim 14 wherein the amount of polymer applied to the cellulose is 0.01 to 1%.

17. A process according to claim 11 wherein the polymer is applied during dyeing in a sizing dyesing process using one-bath sizing and dyeing of cellulose amterials with sulphur dyestuffs.

* * * * *

UNITED STATES PATENT AND TRADEMARK OFFICE

CERTIFICATE OF CORRECTION

PATENT NO. : 4,810,254

DATED : MARCH 7, 1989

INVENTOR(S) : BAUER ET AL

It is certified that error appears in the above-identified patent and that said Letters Patent is hereby corrected as shown below:

In the Specification:

In column 4, line 28, "N-vinylaceylamides" should read --"N-vinylacylamides--.

In column 5, lines 27-28, the formula for XIII should read -- $HOOC-R^{22}-CO-NH-(CH_2)_u-NH\text{—}[(CH_2)_u-NH]_w-R^{23}$ --. In line 32, the formula for "T" should read -- $\text{—}[(CH_2)_s-NH]_v-H$ --.

In column 8, lines 24-30, the formulas should read as follows:

-- $H_2N-CH_2-CH_2-CH_2-NH-CH_2-CH_2-CH_2-NH_2$ --

-- $H_2N-CH_2-CH_2-CH_2-NH-CH_2-CH_2-NH-CH_2-CH_2-CH_2-NH_2$ --

-- $H_2N-CH_2-CH_2-NH-CH_2-CH_2-NH-CH_2-CH_2-NH-CH_2-CH_2-NH_2$ --

In column 19, line 39, "Leon" should read -- Leonil--.

UNITED STATES PATENT AND TRADEMARK OFFICE

CERTIFICATE OF CORRECTION

PATENT NO. : 4,810,254

DATED : MARCH 7, 1989

INVENTOR(S) : BAUER ET AL

It is certified that error appears in the above-identified patent and that said Letters Patent is hereby corrected as shown below:

In the Claims:

In claim 12, formula XIII should read:

-- $HOOC-R^{22}-CO-NH-(CH_2)_u-NH-[(CH_2)_u-NH]_w-R^{23}$ --.

Signed and Sealed this

Thirtieth Day of July, 1991

*Attest:*

HARRY F. MANBECK, JR.

*Attesting Officer*

*Commissioner of Patents and Trademarks*